US005402647A

United States Patent [19]

Bonaquist et al.

[11] Patent Number: 5,402,647

[45] Date of Patent: Apr. 4, 1995

[54] CRYOGENIC RECTIFICATION SYSTEM FOR PRODUCING ELEVATED PRESSURE NITROGEN

[75] Inventors: Dante P. Bonaquist; Mark J. Roberts, both of Grand Island, N.Y.

[73] Assignee: Praxair Technology, Inc., Danbury, Conn.

[21] Appl. No.: 217,812

[22] Filed: Mar. 25, 1994

[51] Int. Cl.[6] ..... F25J 3/02

[52] U.S. Cl. ..... 62/24; 62/25; 62/38; 62/39

[58] Field of Search ..... 62/22, 24, 25, 38, 39

[56] References Cited

U.S. PATENT DOCUMENTS

| | | | |
|---|---|---|---|
| 4,222,756 | 9/1980 | Thorogood | 62/13 |
| 4,448,595 | 5/1984 | Cheung | 62/31 |
| 4,453,957 | 6/1984 | Pahade et al. | 62/25 |
| 4,605,427 | 8/1986 | Erickson | 62/39 X |
| 4,717,410 | 1/1988 | Grenier | 62/29 |
| 4,854,954 | 8/1989 | Erickson | 62/38 X |
| 4,927,441 | 5/1990 | Agrawal | 62/39 X |
| 5,006,139 | 4/1991 | Agrawal et al. | 62/24 |
| 5,069,699 | 12/1991 | Agrawal | 62/24 |
| 5,098,457 | 3/1992 | Cheung et al. | 62/24 |
| 5,222,365 | 6/1993 | Nenov | 62/39 |
| 5,231,837 | 8/1993 | Ha | 62/39 X |
| 5,233,838 | 8/1993 | Howard | 62/25 |
| 5,245,832 | 9/1991 | Roberts | 62/24 |
| 5,309,719 | 5/1994 | Agrawal et al. | 62/22 |
| 5,331,818 | 7/1994 | Rathbone | 62/38 X |
| 5,341,646 | 8/1994 | Agrawal et al. | 62/25 |

*Primary Examiner*—Christopher Kilner
*Attorney, Agent, or Firm*—Stanley Ktorides

[57] ABSTRACT

A cryogenic rectification system for producing large quantities of elevated pressure nitrogen employing an additional column operating at a pressure intermediate to that of higher and lower pressure columns, thereby optimizing nitrogen recovery by improving the flexibility of refrigeration production.

17 Claims, 5 Drawing Sheets

CRYOGENIC RECTIFICATION SYSTEM FOR PRODUCING ELEVATED PRESSURE NITROGEN

TECHNICAL FIELD

This invention relates generally to the cryogenic rectification of mixtures comprising oxygen and nitrogen, e.g. air, and more particularly to the production of elevated pressure nitrogen gas product.

BACKGROUND ART

The cryogenic separation of mixtures such as air to produce nitrogen is a well established industrial process. Liquid and vapor are passed in countercurrent contact through a column of a cryogenic rectification plant and the difference in vapor pressure between the oxygen and nitrogen causes nitrogen to concentrate in the vapor and oxygen to concentrate in the liquid. The lower the pressure is in the separation column, the easier is the separation due to vapor pressure differential. Accordingly, the separation for producing product nitrogen is generally carried out at a relatively low pressure.

Often product nitrogen gas is desired at a high pressure. In such situations, the product nitrogen gas is compressed to the desired pressure in a compressor. This compression is costly in terms of energy costs as well as capital costs for the product compressors. Moreover, the compression of the nitrogen product gas may generate impurities such as particulates and these impurities may be detrimental if the nitrogen gas is to be used in an application requiring high purity, such as in the manufacture of semiconductors. In such instances, a further purification step for the nitrogen gas product may be necessary.

There are known to the art single column and double column processes which can produce elevated pressure nitrogen with high recovery. However, a problem with existing high recovery processes is that at least part of the product nitrogen is recovered at a pressure significantly less than that of the feed. This is disadvantageous when all or most of the nitrogen product is required at an elevated pressure since there is required compression of at least some of the nitrogen gas taken from the column system.

Accordingly, it is an object of this invention to provide a cryogenic rectification system wherein product nitrogen gas may be efficiently produced at an elevated pressure without the need to compress nitrogen gas product taken from the column system.

SUMMARY OF THE INVENTION

The above and other objects, which will become apparent to one skilled in the art upon a reading of this disclosure, are attained by the present invention, one aspect of which is:

A cryogenic rectification method for producing elevated pressure nitrogen gas comprising:

(A) passing feed comprising nitrogen and oxygen into a first column operating at a high pressure, and separating the feed by cryogenic rectification within the first column into high pressure nitrogen vapor and first oxygen-enriched liquid;

(B) passing first oxygen-enriched liquid into a second column operating at an intermediate pressure, and separating the first oxygen-enriched liquid by cryogenic rectification within the second column into nitrogen-enriched vapor and second oxygen-enriched liquid;

(C) passing nitrogen-enriched vapor into a third column operating at a low pressure, and separating the nitrogen-enriched vapor by cryogenic rectification within the third column into nitrogen-containing fluid and oxygen-containing fluid; and (D) recovering at least some of the high pressure nitrogen vapor as elevated pressure nitrogen gas product.

Another aspect of the invention is:

A cryogenic rectification apparatus for producing elevated pressure nitrogen gas comprising:

(A) a first column, and means for passing feed into the first column;

(B) a second column., and means for passing liquid from the lower portion of the first column into the second column;

(C) a third column, and means for passing vapor from the upper portion of the second column into the third column; and (D) means for recovering elevated pressure nitrogen gas taken from the upper portion of the first column.

As used herein, the term "column" means a distillation or fractionation column or zone, i.e., a contacting column or zone wherein liquid and vapor phases are countercurrently contacted to effect separation of a fluid mixture, as for example, by contacting the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook, Fifth Edition, edited by R. H. Perry and C. H. Chilton, McGraw-Hill Book Company, New York, Section 13, "Distillation" B. D. Smith, et al , page 13-3, *The Continuous Distillation Process.*

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 150 degrees K.

As used herein, the term "indirect heat exchange" means the bringing of two fluid streams into heat exchange relation without any physical contact or intermixing of the fluids with each other.

As used herein, the term "feed air" means a mixture comprising primarily nitrogen and oxygen such as air.

As used herein, the terms "upper portion" and "lower portion" of a column mean respectively the upper half and the lower half of the column.

As used herein the term "liquid nitrogen" means a liquid having a nitrogen concentration of at least 99 mole percent.

As used herein, the terms "turboexpansion" and "turboexpander" mean respectively method and apparatus for the flow of high pressure gas through a turbine to reduce the pressure and the temperature of the gas thereby generating refrigeration.

DETAILED DESCRIPTION

In general, the present invention comprises a third distillation column operating at a pressure level between that of the high and low pressure columns to increase the recovery of nitrogen above that which can be obtained from two column arrangements. A degree of freedom (operating pressure) is obtained by adding the intermediate pressure column. This degree of freedom is used to optimize nitrogen recovery and provides additional flexibility for producing refrigeration. The flexibility in producing refrigeration is used to simultaneously maintain high nitrogen recovery, keep feed air pressure only slightly above the required nitrogen product pressure and produce a sufficient quantity of refrigeration to maintain the process at low temperature and, optionally, make some fraction of the product nitrogen as liquid. As stated, the primary feature of the present invention is a separate stripping column operating at a pressure intermediate to that of the high and low pressure columns. The function of this column is to enrich descending liquid in oxygen. By operating the intermediate pressure column at a lower L/V (which favors the enrichment of the descending liquid in oxygen) than the bottom portion of the low pressure column, the oxygen content of the waste stream may be increased. A liquid stream withdrawn from the bottom of the intermediate pressure column is rejected to the condenser of the low pressure column where it is mixed with liquid from the base of the low pressure column and vaporized to form the waste stream. The additional separation provided by the stages of the intermediate pressure column is ultimately manifested as an increase in the recovery of high pressure nitrogen product. The flexibility gained from the presence of the intermediate pressure column provides more options for locating one or more expansion turbines within the process so that the refrigeration requirements of the plant can be satisfied and at the same time, the feed air pressure is maintained slightly above the required nitrogen product pressure which is the most efficient condition for the production of nitrogen gas at elevated pressures.

The intermediate pressure column, which is relatively short (approximately 10 stages compared to 40 or more for the high and low pressure columns) is generally located above the high pressure column. The height of the combined high and intermediate pressure columns is significantly less than that of a conventional double column arrangement. The present invention does not require that the low pressure column be located above the high pressure column; however it may be located there if such an arrangement is advantageous. For many applications, location of the low pressure column along side of the high pressure column will be the preferred arrangement because it permits more cost effective packaging of the air separation system.

Figure 1:
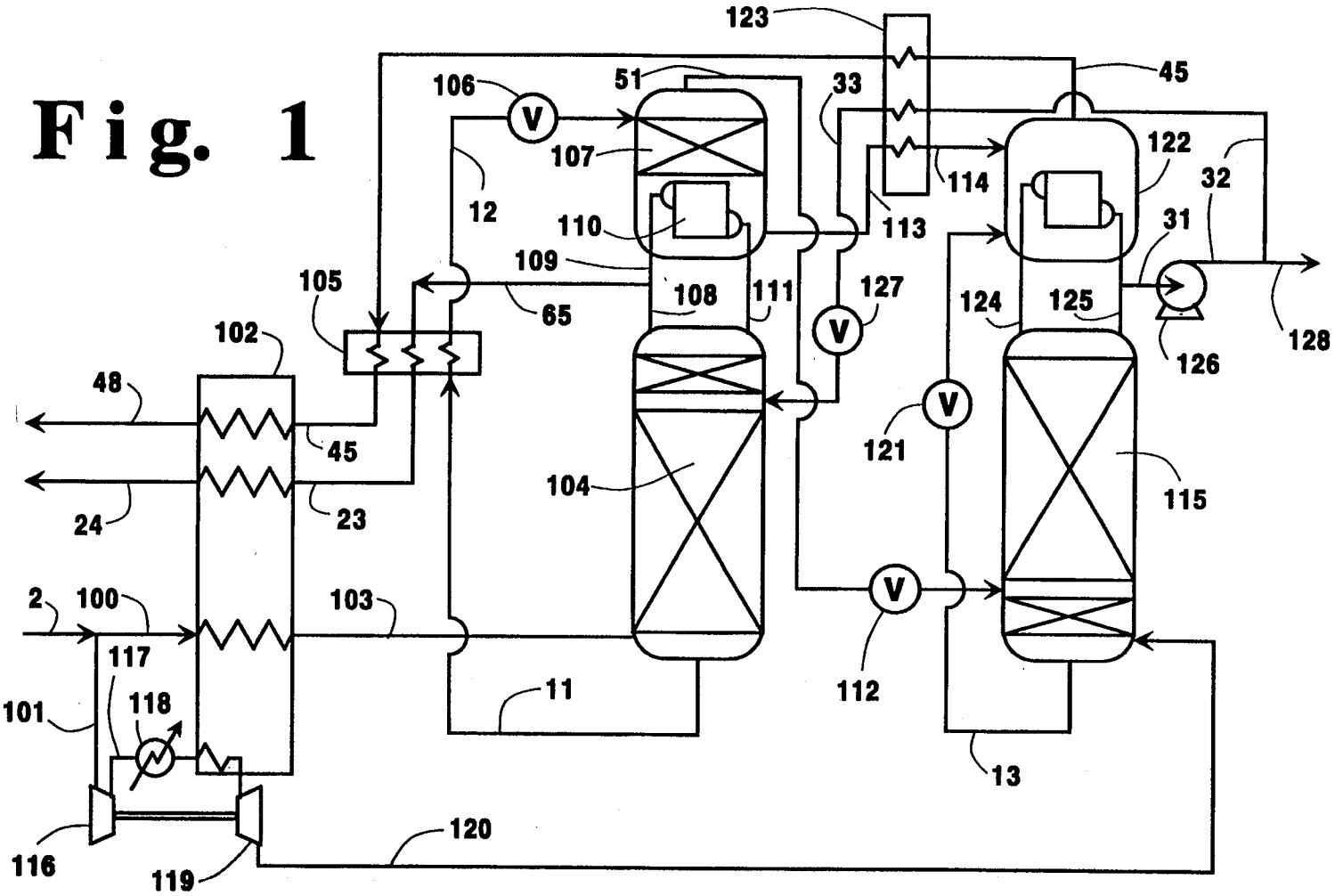
FIG. 1 is a schematic representation of one preferred embodiment of the invention wherein process refrigeration is generated by the turboexpansion of a feed air fraction.

The invention will be described in greater detail with reference to the Drawings. Referring now to FIG. 1, feed air 2, which has been cleaned of high boiling impurities such as carbon dioxide, water vapor and hydrocarbons, is divided into two streams, 100 and 101. Stream 100 is cooled by passage through main heat exchanger 102 and resulting cooled feed air stream 103 is passed into first column 104 operating at a high pressure generally within the range of from 90 to 200 pounds per square inch absolute (psia). Within first column 104 the feed air is separated by cryogenic rectification into high pressure nitrogen vapor, having a nitrogen concentration of up to 99.99 mole percent or more, and into first oxygen-enriched liquid, having an oxygen concentration generally within the range of from 25 to 40 mole percent.

First oxygen-enriched liquid is withdrawn from the lower portion of first column 104 in stream 11 and subcooled by passage through heat exchanger 105 by indirect heat exchange with return streams. Resulting stream 12 is passed through valve 106 and into the upper portion of second column 107 which is operating at an intermediate pressure, less than the operating pressure of first column 104, and generally within the range of from 50 to 85 psia. Within second column 107 the first oxygen-enriched liquid is separated by cryogenic rectification into nitrogen-enriched vapor, having a nitrogen concentration generally within the range of from 60 to 90 mole percent, and into second oxygen-enriched liquid, having an oxygen concentration generally within the range of from 40 to 70 mole percent.

High pressure nitrogen vapor is withdrawn from the upper portion of first column 104 as stream 108. A portion 65 of stream 108 is warmed by passage through heat exchanger 105 and resulting warmed stream 23 is further warmed by passage through main heat exchanger 102, thus serving, in part, to carry out the aforesaid cooling of the feed air. Resulting stream 24 is withdrawn from main heat exchanger 102 and recovered as elevated pressure nitrogen gas product at a pressure generally within the range of from 90 to 200 psia and having a nitrogen concentration of up to 99.99 mole percent or more.

Another portion 109 of stream 108 is passed into condenser/reboiler 110 wherein it is condensed by indirect heat exchange with second oxygen-enriched liquid thereby serving to provide vapor boilup for second column 107. Resulting condensed nitrogen stream 111 is passed from condenser/reboiler 110 into the upper portion of first column 104 as reflux.

Nitrogen-enriched vapor is withdrawn from the upper portion of second column 107 as stream 51, passed through valve 112 and then into the lower portion of third column 115. Third column 115 is operating at a low pressure which is less than the operating pressure of second column 107 and generally within the range of from 30 to 60 psia.

Feed air stream 101 is compressed by passage through compressor 116 to a pressure generally within the range of from 140 to 250 psia. Resulting compressed stream 117 is cooled by passage through cooler 18 to remove the heat of compression, further cooled by partial traverse of main heat exchanger 102 and turboexpanded to about the operating pressure of third column 115 by passing through turboexpander 119. Resulting turboexpanded stream.120 is passed into the lower portion of third column 115.

Within third column 115 the feeds to the third column are separated by cryogenic rectification into nitrogen containing fluid, having a nitrogen concentration generally within the range of from 99 to 99.999 mole percent, and into oxygen-containing fluid having an oxygen concentration generally within the range of from 35 to 50 mole percent.

Oxygen-containing fluid is withdrawn as liquid stream 13 from the lower portion of third column 115, passed through valve 121 and into the vaporizing section of top condenser 122. Second oxygen-enriched liquid is withdrawn from the lower portion of second column 107 as stream 113, subcooled by passage through heat exchanger 123 and passed as stream 114 into the vaporizing section of top condenser 122. Nitrogen-containing fluid is passed as vapor stream 124 from the upper portion of third column 115 into the condensing section of top condenser 122.

Within top condenser 122 the nitrogen-containing fluid is condensed by indirect heat exchange with the liquids passed into the vaporizing side to produce liquid nitrogen and waste gas. The waste gas is withdrawn from top condenser 122 as stream 45, progressively warmed by passage through heat exchangers 123, 105 and 102, and removed from the system as stream 48.

The condensed nitrogen-containing fluid, i.e. liquid nitrogen, is passed as steam 125 into third column 115 as reflux. Preferably a portion 31 of stream 125 is increased in pressure by passage through liquid pump 126 to about the operating pressure of first column 104. Resulting pressurized stream 32 is warmed by passage through heat exchanger 123 and resulting stream 33 is passed through valve 127 and into the upper portion of first column 104 wherein it serves as additional reflux for the cryogenic rectification. If desired, a portion 128 of stream 32 may be recovered as product liquid nitrogen.

FIGS. 2–5 illustrate some other embodiments of the invention. In order to avoid unnecessary redundancy, the embodiments illustrated in FIGS. 2–5 will be discussed in detail only in those aspects which differ from the embodiment illustrated in FIG. 1. The numerals in the Figures are the same for the common elements.

Figure 2:
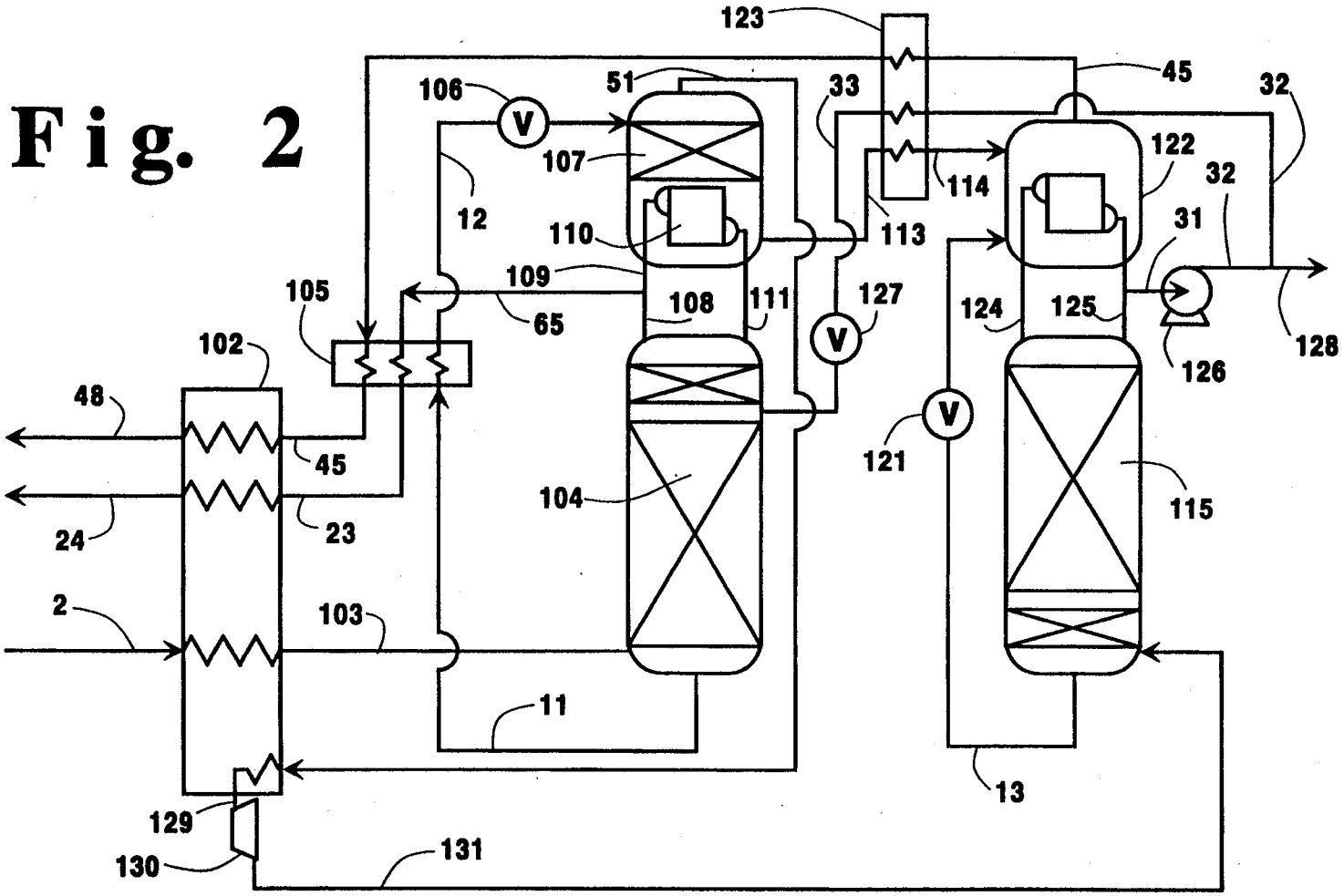
FIG. 2 is a schematic representation of a preferred embodiment of the invention wherein process refrigeration is generated by turboexpansion of a gas stream taken from the intermediate pressure column.

FIG. 2 illustrates an embodiment wherein nitrogen-enriched vapor is turboexpanded prior to being passed into the third column and the entire feed stream is passed into the first column without a portion undergoing compression and turboexpansion. Referring now to FIG. 2, nitrogen-enriched vapor is withdrawn from the upper portion of second column 107 as stream 51, and warmed by partial traverse of main heat exchanger 102. Resulting stream 129 is then turboexpanded by passage through turboexpander 130 to about the operating pressure of third column 115 and then passed as stream 131 into the lower portion of third column 115. With the embodiment illustrated in FIG. 2, process refrigeration is generated by turboexpansion of nitrogen-enriched vapor rather than by turboexpansion of a feed air stream.

Figure 3:
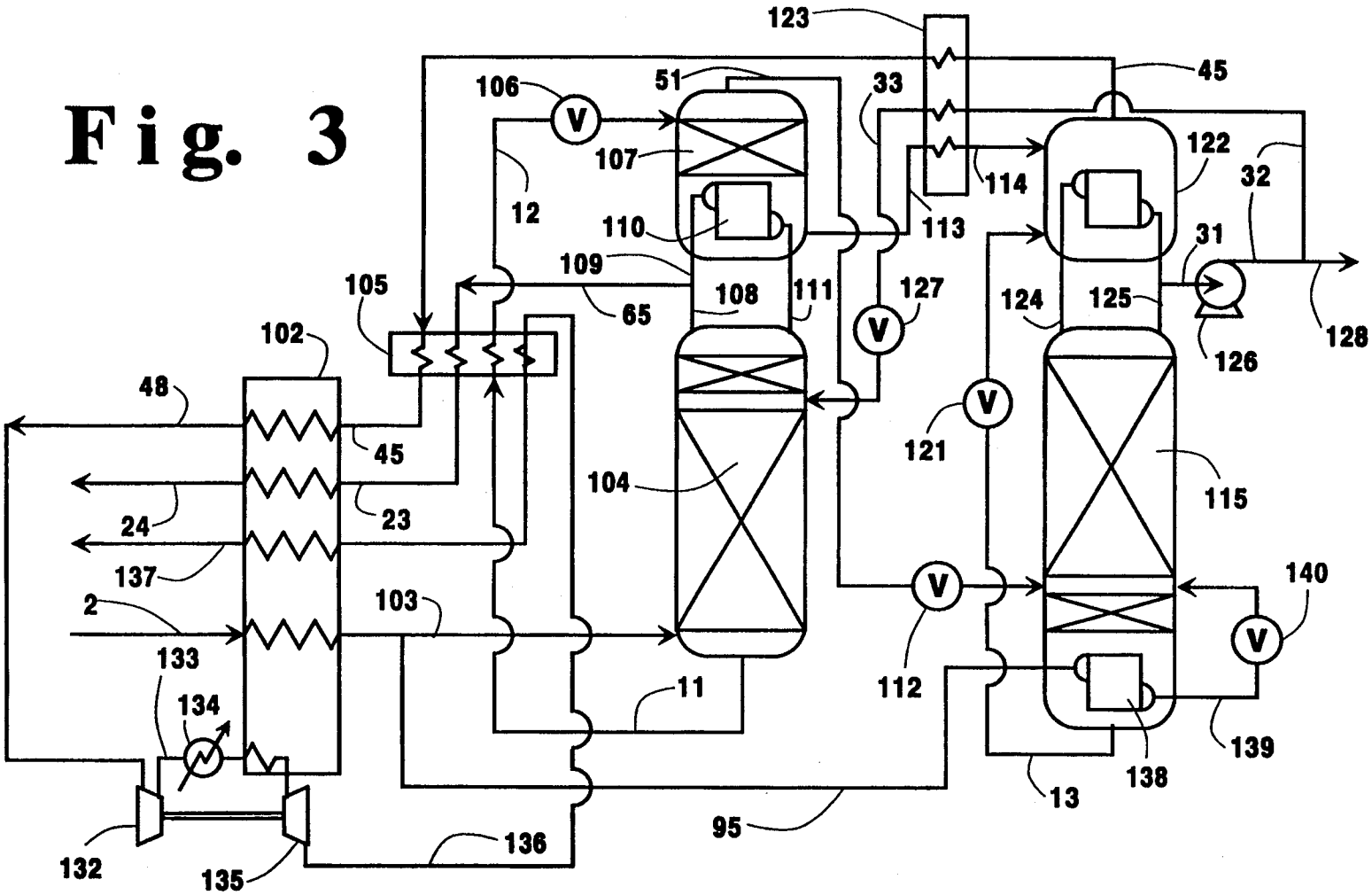
FIG. 3 is a schematic representation of a preferred embodiment of the invention wherein process refrigeration is generated by the turboexpansion of a waste stream.

FIG. 3 illustrates an embodiment wherein process refrigeration is generate by the turboexpansion of waste gas. Referring now to FIG. 3, stream 48 is not removed from the system but, rather, is compressed by passage through compressor 132 to a pressure generally within the range of from 20 to 50 psia. Resulting compressed stream 133 is cooled by passage through cooler 134 to remove the heat of compression, further cooled by partial traverse of main heat exchanger 102 and turboexpanded to a pressure generally within the range of from 15 to 20 psia by passage through turboexpander 135. Resulting turboexpanded stream 136 is warmed by passage through heat exchangers 105 and 102 and removed from the system as stream 137. In passing through main heat exchanger 102, the turboexpanded waste stream serves to cool the feed air thus incorporating the generated refrigeration into the system.

Additionally, in the embodiment illustrated in FIG. 3, a portion 95 of the feed air is passed into reboiler 138 wherein it is condensed by indirect heat exchange with oxygen-containing fluid. Resulting condensed stream 139 is then passed through valve 140 and then into third column 115! .

Figure 4:
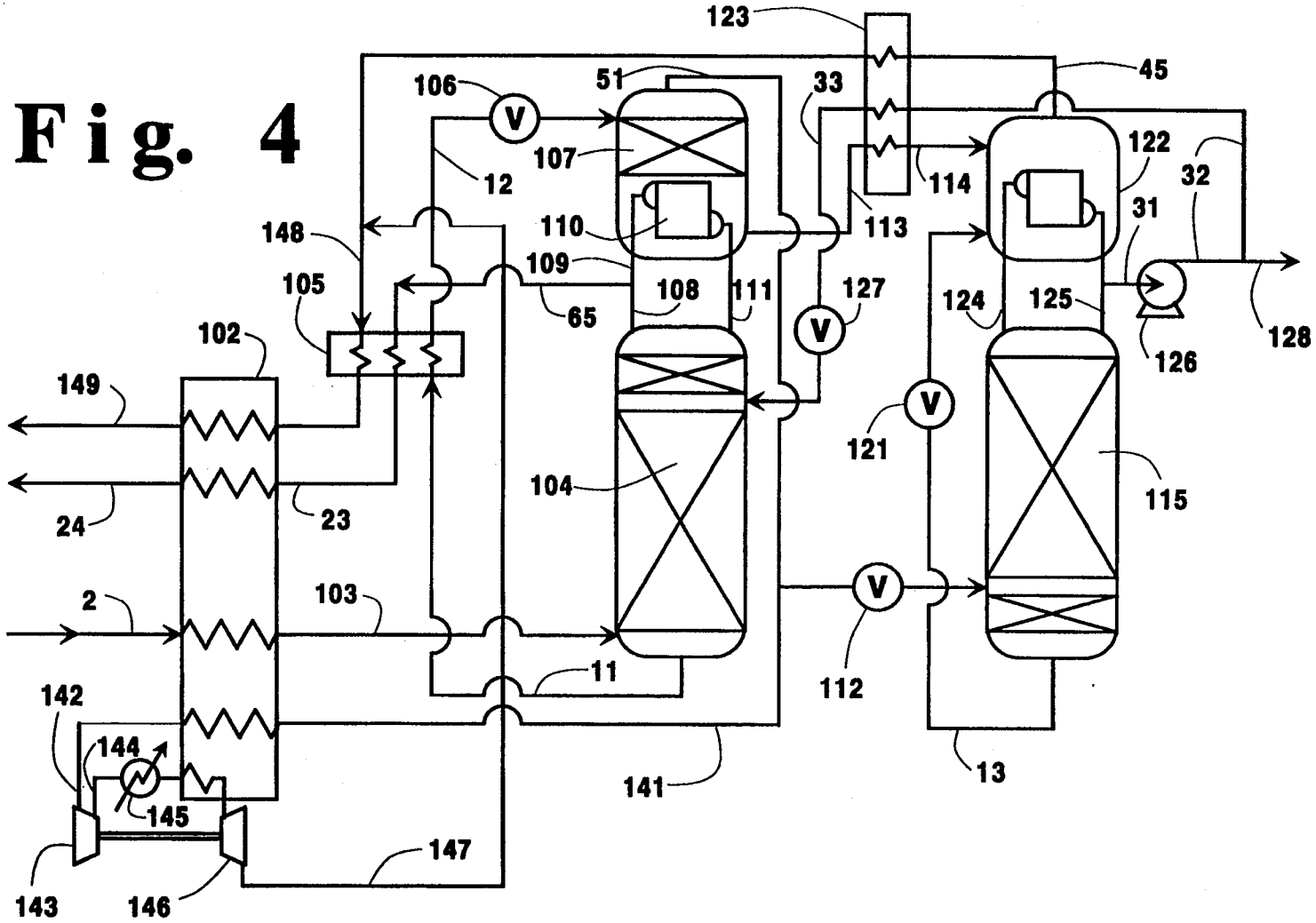
FIG. 4 is another schematic representation of a preferred embodiment of the invention wherein process refrigeration is generated by the turboexpansion of a waste stream.

FIG. 4 illustrates an embodiment wherein a portion of the nitrogen-enriched vapor is compressed and then turboexpanded to generate refrigeration. Referring now to FIG. 4, a portion 141 of stream 51 is not passed into third column 115 but, rather, is warmed by passage through main heat exchanger 102. Resulting stream 142 is then compressed by passage through compressor 143 to a pressure generally within the range of from 50 to 100 psia. Resulting compressed stream 144 is cooled by passage through cooler 145 to remove heat of compression, further cooled by partial traverse of main heat exchanger 102 and turboexpanded to a pressure generally within, the range of from 15 to 20 psia. Resulting turboexpanded stream 147 is combined with stream 45 to form combined stream 148 which is then warmed by passage through heat exchangers 105 and 102 and removed from the system as stream 149. In passing through main heat exchanger 102, stream 148, which includes turboexpanded stream 147, serves to cool the feed air thus incorporating the generated refrigeration into the system.

Figure 5:
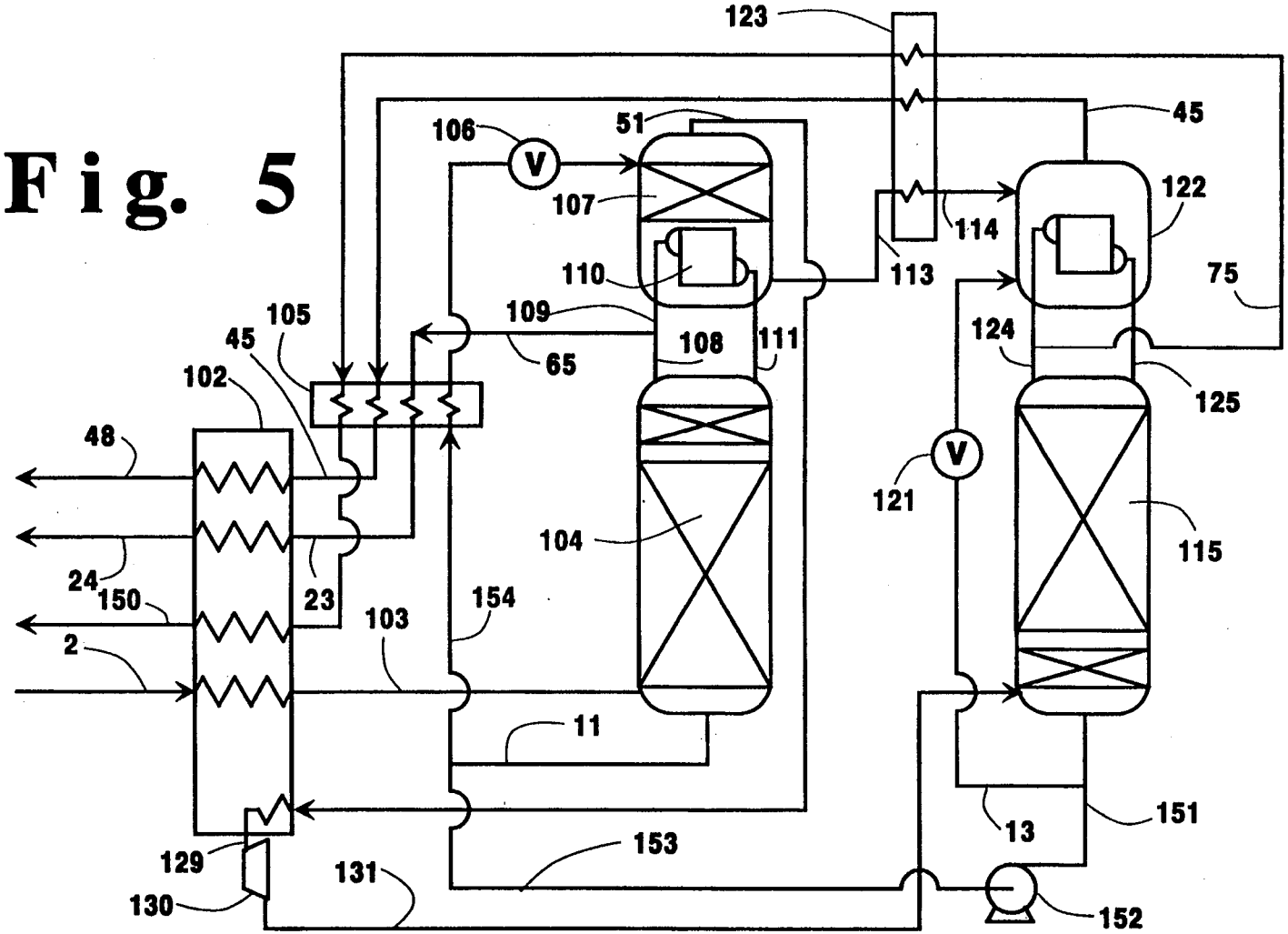
FIG. 5 is a schematic representation of another embodiment of the invention wherein some lower pressure nitrogen product is additionally produced.

FIG. 5 illustrates an embodiment similar to that of FIG. 2 except that additionally some nitrogen-containing fluid is recovered as lower pressure nitrogen gas product. Referring now to FIG. 5, a portion 75 of nitrogen-containing fluid 124 is not passed into top condenser 122 but, rather, is warmed by successive passage through heat exchangers 123, 105 and 102 and recovered as lower pressure nitrogen gas product 150.

Additionally, in the embodiment illustrated in FIG. 5, a portion 151 of stream 13 is not passed into top condenser 122 but, rather, is increased in pressure by passage through liquid pump 152. Resulting pressurized stream 153 is then combined with stream 11 to form combined stream 154 which is cooled by passage through heat exchanger 105 and then passed through valve 106 and into the upper portion of second column 107.

Although the invention has been described in detail with reference to certain preferred embodiments, those skilled in the art will recognize that there are other embodiments of the invention within the spirit and the scope of the claims.

We claim:

1. A cryogenic rectification method for producing elevated pressure nitrogen gas comprising:

(A) passing feed comprising nitrogen and oxygen into a first column operating at a high pressure, and separating the feed by cryogenic rectification within the first column into high pressure nitrogen vapor and first oxygen-enriched liquid;

(B) passing first oxygen-enriched liquid into a second column operating at an intermediate pressure, and separating the first oxygen-enriched liquid by cryogenic rectification within the second column into nitrogen-enriched vapor and second oxygen-enriched liquid;

(C) passing nitrogen-enriched vapor into the lower portion of a third column operating at a low pressure, and separating the nitrogen-enriched vapor by cryogenic rectification within the third column into nitrogen-containing fluid and oxygen-containing fluid;

(D) recovering at least some of the high pressure nitrogen vapor as elevated pressure nitrogen gas product; and (E) passing the nitrogen-containing fluid and the oxygen-containing fluid into a top condenser, condensing the nitrogen-containing fluid by indirect heat exchange with the oxygen-containing fluid within the top condenser, and passing some of the resulting nitrogen-containing liquid into the third column.

2. The method of claim 1 wherein nitrogen-containing fluid produced in the third column is increased in pressure and passed into the first column.

3. The method of claim 1 further comprising compressing a stream comprising nitrogen and oxygen, turboexpanding the compressed stream, and passing the turboexpanded stream into the third column.

4. The method of claim 1 wherein the nitrogen-enriched vapor is turboexpanded prior to being passed into the third column.

5. The method of claim 1 further comprising condensing a stream comprising nitrogen and oxygen by indirect heat exchanger with oxygen-containing fluid and passing the condensed stream into the third column.

6. The method of claim 1 further comprising passing oxygen-containing fluid in indirect heat exchange with nitrogen-containing fluid to produce waste gas, compressing the waste gas, turboexpanding the compressed waste gas, and passing the turboexpanded waste gas in indirect heat exchange with feed to cool the feed prior to passing the feed into the first column.

7. The method of claim 1 further comprising compressing nitrogen-enriched vapor, turboexpanding the compressed nitrogen-enriched vapor, and passing the turboexpanded nitrogen-enriched vapor in indirect heat exchange with feed to cool the feed prior to passing the feed into the first column.

8. The method of claim 1 further comprising recovering nitrogen-containing fluid as lower pressure nitrogen gas product.

9. The method of claim 1 further comprising recovering nitrogen-containing fluid as product liquid nitrogen.

10. The method of claim 1 further comprising increasing the pressure of a stream of oxygen-containing fluid withdrawn from the third column and passing the pressurized oxygen-containing fluid stream into the second column.

11. The method of claim 1 further comprising passing second oxygen-enriched liquid from the lower portion of the second column into the top condenser.

12. A cryogenic rectification apparatus for producing elevated pressure nitrogen gas comprising:

(A) a first column, and means for passing feed into the first column;

(B) a second column, and means for passing liquid from the lower portion of the first column into the second column;

(C) a third column, and means for passing vapor from the upper portion of the second column into the lower portion of the third column;

(D) means for recovering elevated pressure nitrogen gas taken from the upper portion of the first column; and (E) a top condenser, means for passing fluid from the upper portion of the third column into the top condenser, means for passing fluid from the lower portion of the third column into the top condenser, and means for passing fluid from the top condenser into the third column.

13. The apparatus of claim 12 further comprising means for increasing the pressure of fluid taken from the upper portion of the third column, and means for passing this pressurized fluid into the first column.

14. The apparatus of claim 12 further comprising a compressor, a turboexpander, means for passing a feed stream from the compressor to the turboexpander, and means for passing said feed stream from the turboexpander into the third column.

15. The apparatus of claim 12 wherein the means for passing vapor from the upper portion of the second column into the third column includes a turboexpander.

16. The apparatus of claim 12 further comprising a compressor, a turboexpander and a heat exchanger, means for passing fluid taken from the upper portion of at least one of the columns to the compressor, means for passing fluid from the compressor to the turboexpander, and means for passing fluid from the turboexpander through the heat exchanger, and wherein the means for passing feed into the column also passes through said heat exchanger.

17. The apparatus of claim 12 further comprising means for passing fluid from the lower portion of the second column into the top condenser.

* * * * *